US006186454B1

(12) United States Patent
Olsen

(10) Patent No.: US 6,186,454 B1
(45) Date of Patent: Feb. 13, 2001

(54) AESTHETICALLY-PLEASING, POST-MOUNTED SIGN HOLDER

(76) Inventor: Dane R. Olsen, 7490 140th St. North, Seminole, FL (US) 33776

( * ) Notice: Under 35 U.S.C. 154(b), the term of this patent shall be extended for 259 days.

(21) Appl. No.: 08/778,392

(22) Filed: Dec. 31, 1996

(51) Int. Cl.[7] ..... A47B 96/06
(52) U.S. Cl. ..... 248/218.4; 40/607; 248/74.1
(58) Field of Search ..... 248/218.4, 219.3, 248/219.4, 74.2, 74.3, 74.1, 230.1, 230.7, 230.8; 40/607, 611

(56) References Cited

U.S. PATENT DOCUMENTS

| | | | | |
|---|---|---|---|---|
| 817,061 | | 4/1906 | Griffin | 248/219.4 |
| 1,205,800 | | 11/1916 | Schwartzberg | 248/230.4 |
| 2,262,873 | | 11/1941 | Wise | 248/230.7 |
| 2,616,196 | | 11/1952 | Sandahl, Jr. | 248/230.4 |
| 2,649,632 | | 8/1953 | Kessler . | |
| 3,119,585 | | 1/1964 | Austenson | 248/219.3 |
| 3,223,467 | | 12/1965 | Jafelice | 248/219.4 |
| 3,445,582 | | 5/1969 | Herrenkohl et al. | 248/219.3 |
| 3,503,580 | | 3/1970 | Levy | 248/219.4 |
| 3,561,712 | | 2/1971 | Newsome | 248/230.4 |
| 4,460,142 | | 7/1984 | O'Rorke . | |
| 4,801,115 | | 1/1989 | Heard | 248/219.3 |
| 4,840,345 | * | 6/1989 | Neil et al. | 248/74.2 |
| 4,871,141 | | 10/1989 | Chen | 248/534 |
| 4,955,574 | * | 9/1990 | Freier | 248/74.2 X |
| 5,088,672 | | 2/1992 | Neuendorf et al. . | |
| 5,189,822 | * | 3/1993 | Schmanski et al. | 40/611 |
| 5,277,387 | * | 1/1994 | Lewis et al. | 248/74.2 |
| 5,305,978 | | 4/1994 | Current . | |
| 5,479,735 | | 1/1996 | Martin, Jr. . | |
| 5,590,859 | * | 1/1997 | Lord | 248/218.4 X |
| 5,595,009 | * | 1/1997 | Rummer | 40/608 X |

* cited by examiner

*Primary Examiner*—Ramon O. Ramirez
(74) *Attorney, Agent, or Firm*—Ronald E. Smith; Smith & Hopen, P.A.

(57) ABSTRACT

An aethetically pleasing sign holder releasably engages a pole or post without requiring tools and protects a sign from the elements. A sign is slid into an opening formed in an edge of a thin, hollow sign housing, and a front wall of the housing is transparent so that the sign within the hollow housing is visible to observers. The sign housing is mounted to a swivally-mounted base and a pair of flexible and resilient, semi-circular parts are integrally formed with the base. The half parts are spread apart from one another to admit a pole between them, and converged toward one another to lock onto the pole. A catch is formed integrally with one of the half parts and a latch that releasably engages the catch is formed integrally with the other half part. The catch and latch include mating teeth that extend along a predetermined circumferential extent to enable attachment of the sign holder to poles of widely varying diameters.

3 Claims, 3 Drawing Sheets

AESTHETICALLY-PLEASING, POST-MOUNTED SIGN HOLDER

BACKGROUND OF THE INVENTION

1. Field of the Invention

This invention relates, generally, to devices for holding advertising or noncommercial signs. More particularly, it relates to an attractive sign holder that is releasably attachable to poles without requiring tools and which protects signs from the elements.

2. Description of the Prior Art

People holding yard sales, garage sales, and the like often attach posters or other informal signs to telephone poles or other post means to advertise their events. Certain sellers of computer memory and other goods or services also employ the same technique to avoid the high cost of formal outdoor advertising billboards.

Such handmade signs are somewhat unsightly and as a result many cities have passed ordinances banning them. The signs are also unprotected from the weather, so they become even more unsightly when rained upon. Moreover, since the signs are usually attached to the post means by very casual means, they are easily taken down by wind or passers-by.

More sophisticated sign holders are also well known, but have not gained consumer acceptance due to their complicated designs, their expense, and other factors such as aesthetics, the need to employ tools when installing them, and so on.

What is needed, then, is an inexpensive sign holder that is attractive in appearance, which may be installed and removed from a post means without tools, and which protects the sign from the effects of weather.

An arcuate compression clamp having utility as a sign holder is disclosed in U.S. Pat. No. 5,305,978 to Current. The clamp releasably engages an elongate cylindrical rod that forms a part of a horizontally disposed display rack and includes a radially extending base to which a sign may be engaged. The sign is always used indoors, and no means are provided or suggested for protecting the sign from the elements. Moreover, the device includes a card holder that engages a card or other sign along its lowermost edge only, i.e., the remaining edges of the sign or card are not secured by the card holder.

Three signs are attached to a parking meter by the device disclosed in U.S. Pat. No. 2,616,196 to Sandahl, Jr. et. al. However, each sign must be bolted to a support plate, so changing signs is not easy. Nor are the signs protected from the elements.

Neuendorf et.al., in U.S. Pat. No. 5,088,672, disclose a sign holder that is bolted to clamps that circumscribe a pole. No means are provided to facilitate sign changing and no means are provided for protecting a sign from the effects of weather.

A spring clip that lightly grips upstanding posts, trees and the like is disclosed in U.S. Pat. No. 2,262,873 to Wise. The Wise device includes no means for sheltering or protecting documents from the elements, and the light grip provided may be unacceptable in some applications.

What is needed, then, is a sign holder that eases the task of sign changing and which protects a sign from the elements. The needed device should also be attachable to a vertical or horizontal post, tree, or other suitable support surface in the absence of bolts and other tool-requiring fastening means. The device should also be attractive and professional in appearance to maximize its aesthetic appeal.

However, in view of the art taken as a whole at the time the present invention was made, it was not perceived by those of ordinary skill in the field of this invention that the needed device should be provided nor was it obvious how the needed device could be provided.

SUMMARY OF THE INVENTION

The longstanding but heretofore unfulfilled need for an apparatus that overcomes the limitations of the prior art is now met by a new, useful, and nonobvious sign holder.

The present invention includes a hollow sign housing having a preselected open edge for slideably receiving a sign into such hollow sign housing. The hollow sign housing has a transparent front wall so that a sign disposed inside the sign housing is visible to onlookers.

The sign housing further includes a flat base for supporting the hollow sign housing, and a post gripping main body integrally formed with the flat base; optionally, the hollow sign housing is rotatably connected to the flat base to enable positioning of the sign housing in any preselected position of rotational adjustment.

The post-gripping main body has a semi-circular first half part and a semi-circular second half part formed of a flexible and resilient material so that the first and second half parts may be transiently displaced away from one another to admit a post means therebetween and brought toward one another to cooperatively embrace a post.

A catch means is formed integrally with the first half part and a latch means is formed integrally with the second half part.

The catch means includes a radially outward part and a radially inward part that are radially spaced apart from one another by a predetermined distance; the radially outward part and radially inward part have a substantially common circumferential extent.

The latch means includes a radially outward part and a radially inward part that are radially spaced apart from one another by a predetermined distance; the radially outward part and radially inward part of the latch means have a substantially common circumferential extent.

It is a primary object of this invention to provide a sign holder that is readily attachable and detachable from a vertical or horizontal support post in the absence of tools yet which provides a very firm, non-slip grip on such post.

Another very important object is to provide a sign holder that facilitates sign changing.

Still another important object is to provide a sign holder that protects signs held by it from the effects of weather.

Yet another object is to accomplish the foregoing objects in an aesthetically pleasing way.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
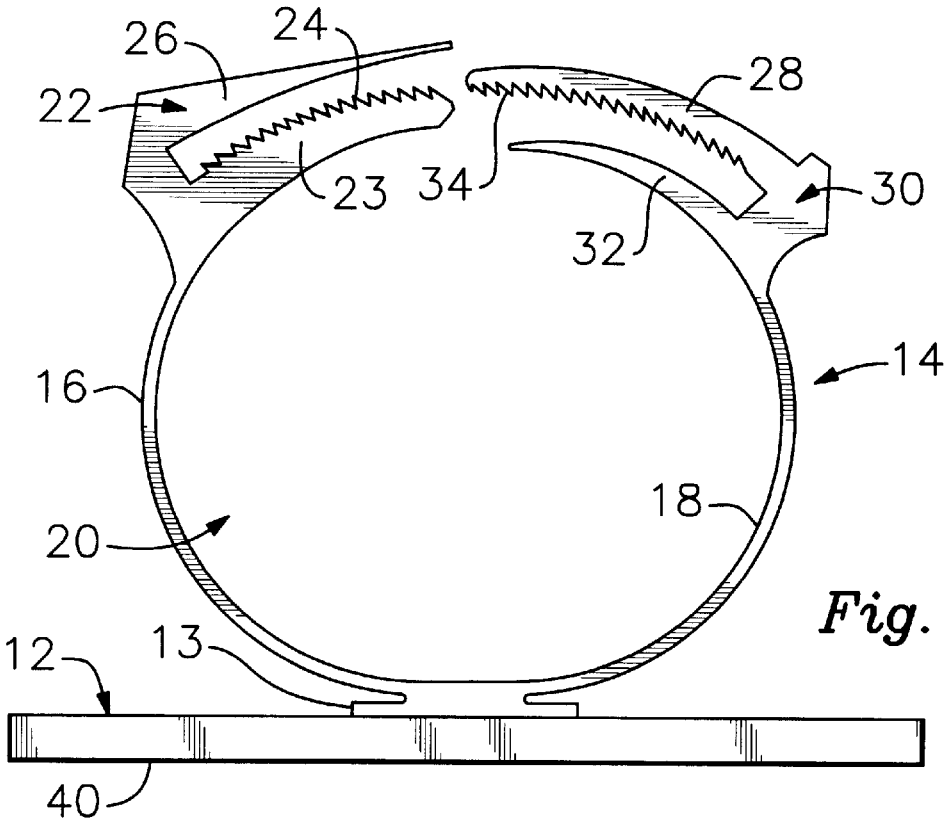
FIG. 1 is a top plan view depicting an illustrative embodiment of the device in its open, post-receiving configuration.
Figure 2:
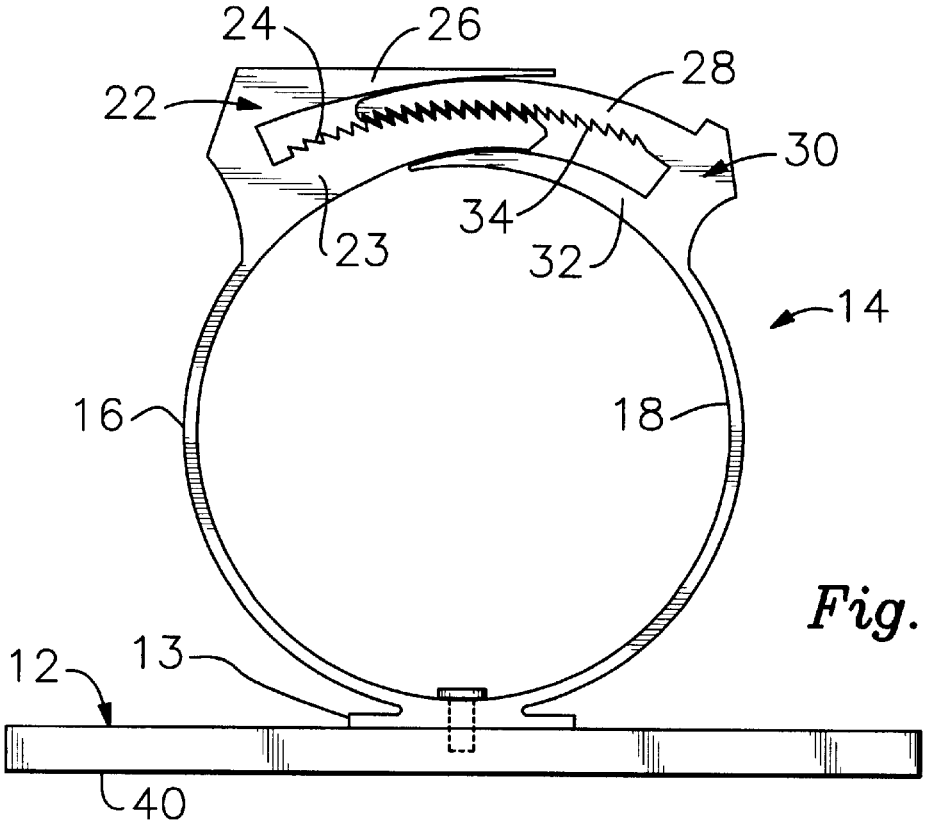
FIG. 2 is a top plan view depicting said embodiment in its closed and locked configuration.

Referring now to FIGS. 1 and 2, it will there be seen that an exemplary embodiment of the invention is denoted as a whole by the reference numeral 10.

Device 10, to be known commercially under the trademark PoleWriter, includes a hollow sign housing 12 of parallelepiped construction that is fixedly secured by suitable means to a flat base 13 that includes a flat surface against which a medial part of housing 12 abuts. Optionally, a pivot pin means 11 may be employed to rotatably connect housing 12 and flat base 13.

A flexible and resilient ring-like main body or pole-gripping means 14 is integrally formed with base 13; said means 14 has a first half 16 and a second half 18 that collectively encircle and define a cylindrical, pole or post receiving area 20 when device 10 is in its closed, pole-gripping configuration as depicted in FIG. 2. Each half part 16 and 18 is of semi-circular configuration as depicted.

Device 10 may be made of any suitable material but preferably is formed of a flexible and resilient high-impact plastic. This enables half parts 16 and 18 to be transiently displaced away from one another as indicated in FIG. 1 to admit a pole into area 20 and to be converged toward one another to cooperatively embrace a pole as indicated in FIG. 2.

Catch 22 is formed integrally with first half 16; it includes a relatively thick radially inward part 23 into a radially outward surface of which is formed a plurality of equidistantly spaced teeth 24 that extend parallel to one another and parallel to a longitudinal axis of cylindrical area 20. Said catch 22 further includes a radially outward part 26 that tapers down to a relatively thin free end as depicted. Note that parts 23 and 26 have a substantially common circumferential extent, that they share a common proximal end, and that their respective free ends are spaced apart from one another by a predetermined distance.

More particularly, thin outward part 26 of catch 22 is radially spaced from thick inward part 23 of said catch to define a space for receiving radially outward part 28 of latch 30.

Latch 30 is integrally formed with second part 18 of main body 14 and further includes a radially inward part 32 of relatively thin construction that tapers down to a thin free end as depicted. Parts 28 and 32 share a substantially common circumferential extent as well as a common proximal end, and their respective free ends are spaced apart from one another by a predetermined distance. The radial spacing between radially outward part 28 and radially inward part 32 is sufficient to snugly receive radially inward part 23 of catch 22, and said three parts are arcuate in configuration to facilitate said reception.

Parts 28 and 32 share a substantially common circumferential extent with one another as aforesaid and with the aforementioned substantially common circumferential extent of parts 23 and 26. Accordingly, the circumferential extent of the spacing between parts 28 and 32 and the spacing between parts 23 and 26 is substantially the same so that the circumferential extent of the spacing between parts 23 and 26 is sufficient to fully receive part 28 of latch means 30 and the circumferential extent of the spacing between parts 28 and 32 is sufficient to fully receive part 23 of catch means 22 when the device is closed about a pole of a predetermined minimum diameter.

A plurality of parallel, equidistantly spaced teeth, collectively denoted 34, are formed on a radially inward surface of latch outward part 28 so that said teeth 34 progressively engage teeth 24 as outward part 28 of latch 30 is progressively introduced into the space defined by inward and outward members 23 and 26 of catch 22.

The spacing between parts 23 and 26 of said catch is similarly preselected to enable snug reception of outward latch part 28 into the space between said parts 23 and 26 during said progressive introduction of said outward part 28.

Thin outward part 26 of catch 22 is sufficiently flexible to enable teeth 34 to ride over teeth 24 during the convergence of half parts 16 and 18 of main body 14, it being understood that said flexibility enables said part 26 to transiently displace radially outwardly as teeth 34 slide over teeth 24. Part 26 is also sufficiently resilient to resume its position of repose as depicted in FIG. 2 after half parts 14 and 16 are positioned in fully embracing relation to a post.

Teeth 24 and 34 are formed along the respective circumferential extents of their respective parts 23 and 28 so that sign holder 10 accommodates poles or posts of widely varying diameters.

Parts 23 and 28 share a substantially common thickness as do parts 26 and 32, the former parts having a greater thickness than the latter.

To release device 10 from a post, the free end of radially outward part 26 of catch 22 is manually lifted, i.e., displaced in a radially outward direction. Teeth 24 and 34 may then disengage due to an inherent resilience of parts 23 and 28, or said teeth may be manually separated from one another if need be. Once the teeth no longer engage one another, half parts 14 and 16 are separated from one another, i.e., the steps required to fasten device 10 to a post are simply reversed.

Figure 3:
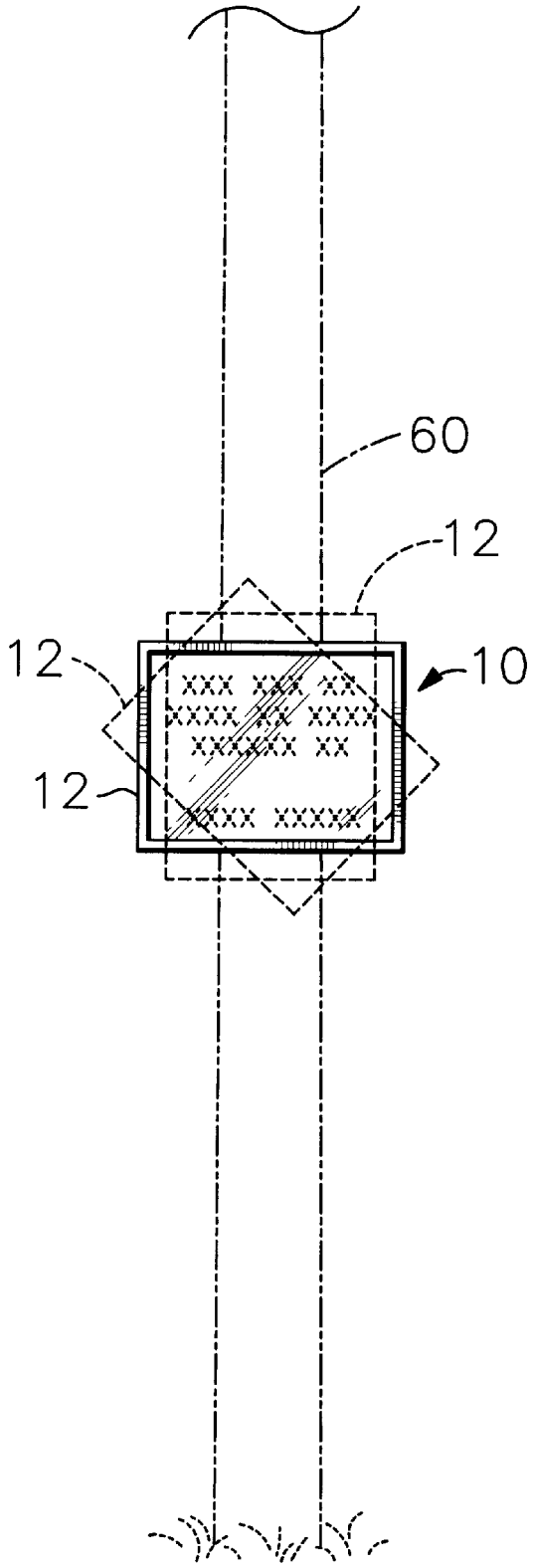
FIG. 3 is a front elevational view of said illustrative embodiment of the invention when installed on a vertical pole.
Figure 4:
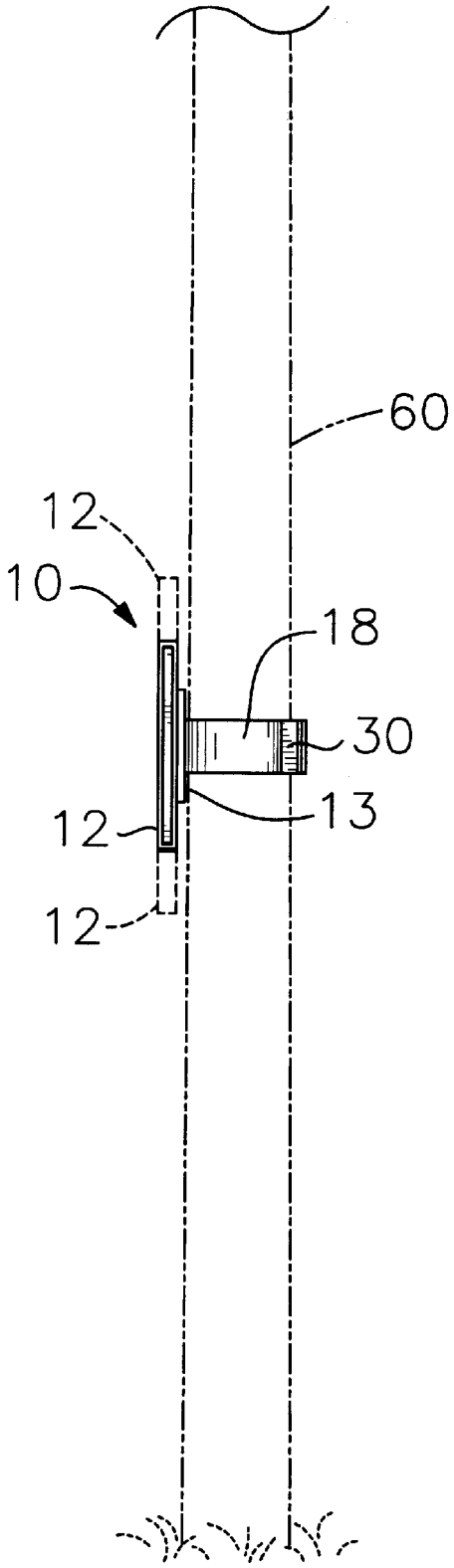
FIG. 4 is a side elevational view thereof.

FIGS. 3 and 4 depict the novel sign holder 10 in front and side elevation, respectively, when mounted on a pole 60; the pole is depicted in phantom lines.

FIGS. 3 and 4 also depict, in phantom lines, a couple of alternative position of sign housing 12 made possible by pivot pin 11. The pivot means could be constructed to allow positioning of sign housing 12 in any preselected position of rotational adjustment, and could further include means for locking said sign housing into each of said preselected positions.

Figure 5:
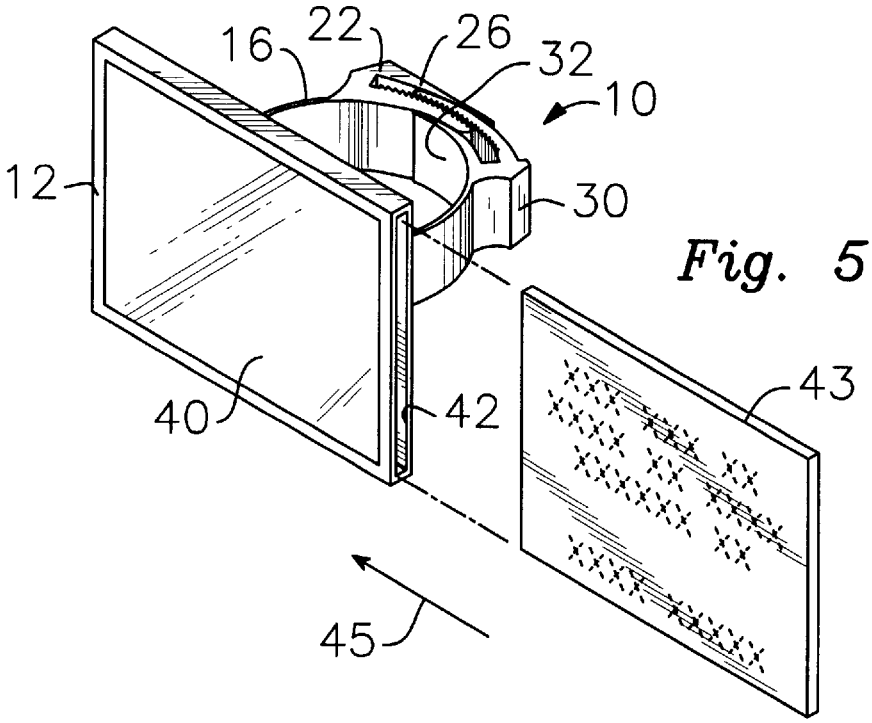
FIG. 5 is a perspective view indicating how a sign can be introduced into a preselected edge of the sign housing.

There is no need, however, to detach device 10 from a post whenever a sign change is desired, Hollow sign housing 12 includes a front wall 40 of transparent construction and includes a slot 42 that extends along the entire extent of a preselected transverse or longitudinal edge thereof. Thus, as depicted in FIG. 5, a sign 43 is introduced into the hollow interior of housing 12 through such slot 42, as indicated by directional arrow 45, and said sign is removed by reversing the insertion procedure. In this way, device 10 may be left in place at all times.

The sign disposed within housing 12 is visible due to the transparent structure of front wall 40 thereof. Advantageously, the structure of housing 12 also protects the sign from the effects of rain, wind, and the like.

Just as importantly, the strong grip provided by the engagement of teeth 24 and 34 to one another ensures that device 10 will remain in place as long as desired.

Figure 6:
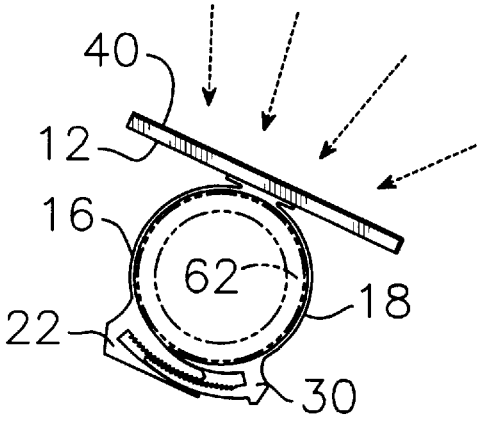
FIG. 6 is an end elevational view of the novel sign holder when installed on a horizontal post.
Figure 6A:
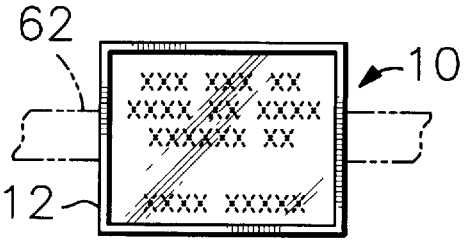
FIG. 6*a* is a front elevational view of the embodiment of FIG. 6.

FIG. 6 depicts novel sign holder 10 in end elevation when attached to a horizontal post 62, and FIG. 6*a* depicts such assembly in front elevation. In such a configuration, it would hold a noncommercial sign such as an informational sign about an animal at a zoo, for example, and it would be viewed from above as indicated by the arrows.

Figure 7:
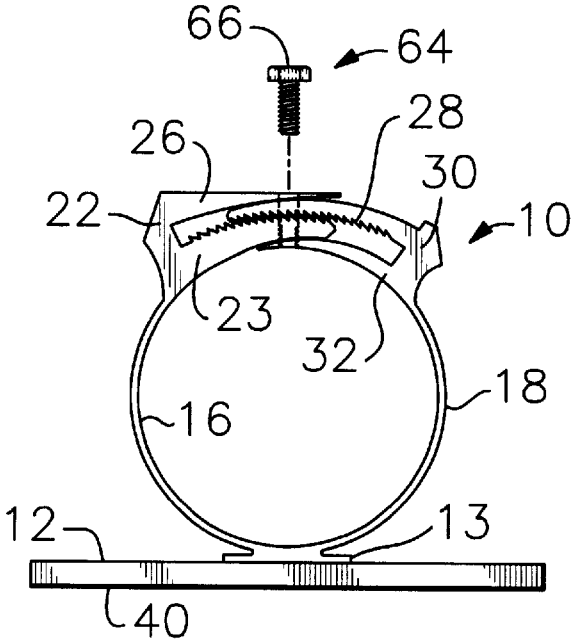
FIG. 7 is a top plan view like that of FIG. 2, but further depicting an alternative locking means that defeats facile removal of the device from a post.

FIG. 7 depicts a locking means that could be added to prevent unauthorized persons from removing device 10 from the post to which it is mounted. A common padlock, not shown, could be employed to lock the device, or a bolt 64 having a special head 66 requiring a special tool to remove it could be employed as well; the bolt would extend through a bore formed in parts 26, 28, 23, and 32. Such special-headed bolts are well known. Numerous other well-known locking means could also be provided, it being understood that the specific locking means used is not critical.

A hinged door assembly and locking means, not shown, could also be added to close slot 42 to prevent unauthorized sign removal.

The professional appearance of device 10 enhances the aesthetics of the post to which it is secured, thereby eliminating the aforementioned complaints about post-mounted signs in general. It also provides a very strong, non-slip grip in the absence of tools and hardware such as nuts and bolts, while protecting signs from the elements and facilitating sign changing.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A sign holder, comprising:

a hollow sign housing having a preselected open edge for slideably receiving a sign into said hollow sign housing when said sign holder is fully assembled and in use;

said hollow sign housing having a transparent front wall;

a flat base for supporting said hollow sign housing;

a pivot pin disposed in interconnecting relation to said hollow sign housing and said flat base;

said pivot pin being centrally disposed with respect to said hollow sign housing and said flat base;

said hollow sign housing being rotatable about said pivot pin so that said hollow sign housing is positionable in a plurality of preselected rotational positions of adjustment relative to said flat base;

a main body integrally formed with said flat base, said main body adapted to grip a post;

said main body having a semi-circular first half part and a semi-circular second half part formed of a flexible and resilient material so that said first and second second half parts may be transiently displaced away from one another to admit a post therebetween and brought toward one another to cooperatively embrace a post;

a catch means formed integrally with said first half part; and a latch means formed integrally with said second half part.

2. The sign holder of claim 1, wherein said housing is formed of a flexible and resilient high-impact plastic.

3. The sign holder of claim 1, wherein said hollow sign housing is of parallelepiped configuration.

* * * * *